US011089664B1

(12) United States Patent
Price et al.

(10) Patent No.: US 11,089,664 B1
(45) Date of Patent: Aug. 10, 2021

(54) LED DRIVER WITH PROGRAMMABLE INTERNAL NTC TEMPERATURE FOLDBACK

(71) Applicant: UNIVERSAL LIGHTING TECHNOLOGIES, INC., Madison, AL (US)

(72) Inventors: Scott Price, Madison, AL (US); Kevin Boyce, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 16/851,492

(22) Filed: Apr. 17, 2020

Related U.S. Application Data

(60) Provisional application No. 62/843,917, filed on May 6, 2019.

(51) Int. Cl.
*H05B 45/56* (2020.01)
*H05B 45/18* (2020.01)

(52) U.S. Cl.
CPC ..... *H05B 45/56* (2020.01); *H05B 45/18* (2020.01)

(58) Field of Classification Search
CPC combination set(s) only.
See application file for complete search history.

(56) References Cited

U.S. PATENT DOCUMENTS

| | | | | |
|---|---|---|---|---|
| 8,450,948 | B2 | 5/2013 | Huang et al. | |
| 9,060,408 | B2 | 6/2015 | Shi et al. | |
| 9,265,119 | B2 | 2/2016 | Catalano et al. | |
| 9,967,939 | B2 | 5/2018 | Bandel et al. | |
| 10,342,094 | B1 | 7/2019 | Goldstein et al. | |
| 10,491,126 | B1 | 11/2019 | Pastore et al. | |
| 10,560,993 | B1 | 2/2020 | Xiong et al. | |
| 2017/0086272 | A1* | 3/2017 | O'Neil | H05B 45/375 |
| 2018/0116020 | A1* | 4/2018 | Beghelli | H05B 45/37 |

* cited by examiner

*Primary Examiner* — Monica C King
(74) *Attorney, Agent, or Firm* — Patterson Intellectual Property Law, P.C.; Gary L. Montle; Alex H. Huffstutter

(57) ABSTRACT

An LED driver includes a temperature sensing circuit integrated within its housing. The sensing circuit generates signals corresponding to actual temperature values within the driver housing to a controller. The controller receives programmable temperature derating parameters at least partially related to a light fixture receiving the driver housing, converts the temperature sensor signal into the actual temperature value, and derates the output current in linear fashion according to a transfer function when the actual temperature value falls within the temperature derating parameters. The parameters may include starting and ending temperatures, and an ending current parameter. The temperature sensing circuit may include a voltage divider with a negative thermal coefficient (NTC) device, preferably as the high side resistor. The temperature sensing circuit may typically provide a non-linear output across the temperature range, wherein the controller converts the non-linear output from the sensing circuit into a linear output for the transfer function.

17 Claims, 10 Drawing Sheets

LED DRIVER WITH PROGRAMMABLE INTERNAL NTC TEMPERATURE FOLDBACK

CROSS-REFERENCES TO RELATED APPLICATIONS

This application claims benefit under 35 USC. § 119(e) of U.S. Provisional Patent Application No. 62/843,917, filed May 6, 2019, entitled "LED Driver with Programmable Internal NTC Temperature Foldback."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present invention relates generally to power supplies for lighting applications, and more particularly, to a power driver configured to limit an output provided to a light-emitting diode (LED)-based load under certain thermal conditions.

LED lighting is increasingly popular due for example to its relatively long life, better lumen output per watt than alternative lighting technologies, and superior dimming capability. LED power drivers drive LED loads at a stable current in order to maintain a stable level of light-emission by the LED load. A given LED load is thermally rated to identify a maximum temperature threshold for safe operation, above which the LED load is likely to suffer substantial and permanent damage.

Thermal protection applicable to LED lighting is configured to prevent damage to the LED lighting fixture's electronics (e.g., an LED module, LED power driver, communications circuitry) and to aid in managing the LED lighting fixture's temperature when in elevated ambient conditions.

Some conventional arrangements have incorporated a negative thermal coefficient (NTC) sensor or temperature sensor remotely coupled to the LED power driver via lead wires. The NTC sensor is typically positioned as near as possible to the LED load within an LED lighting fixture so as to accurately measure the temperature of the LED load. However, such conventional arrangements are not adjustable or configurable for the specific LED load attached thereto.

Some LED power drivers compatible with NTC sensors include hard-coded transfer functions which are not adjustable. Correspondingly, the temperature breakpoints and ending current are not dynamically adjustable as needed, and manufacturers of conventional light fixtures are effectively forced to exactly match their NTC behavior to desired results based on the hard-coded (i.e., fixed) temperature breakpoints and ending current set by the transfer function.

BRIEF SUMMARY

Accordingly, a need exists for a generally applicable method for fixture manufacturers to add thermal protection to their lighting fixtures by incorporating the temperature sensor into the LED driver having programmable interface configured to make the temperature ranges and the current level at an ending temperature adjustable. The fixture manufacturer can select the programmable temperature ranges and ending current level to reduce the fixture's temperature self-rise during unexpected elevated ambient temperature conditions, thereby potentially reducing damage and warranty returns and also prolonging product life.

Various examples of such inventive methods and apparatus as disclosed herein can also reduce the total fixture cost by eliminating the need to run extra wires between the LED driver and LED module for a discrete temperature sensor.

Various examples of such inventive methods and apparatus as disclosed herein can also greatly reduce the development time of the fixture by eliminating the need to experimentally place the NTC/sensor to make the sensed temperature match a hard-coded temperature foldback transfer function over the fixture manufacturer's desired operating range.

A particular exemplary embodiment is disclosed herein of an LED driver configured to supply an output current to an LED load. The LED driver comprises a driver housing having disposed therein a temperature sensing circuit configured to generate a temperature sensor signal corresponding to an actual temperature value within the driver housing, and a controller circuit coupled to the temperature sensing circuit. The controller circuit is configured to: receive programmable temperature derating parameters at least partially related to a light fixture configured to receive the driver housing; convert the temperature sensor signal into the actual temperature value; and derate the output current in accordance with a transfer function of the controller circuit when the actual temperature value falls within the temperature derating parameters.

In one exemplary aspect of the above-referenced embodiment, the temperature derating parameters include a starting temperature, an ending temperature, and an ending current parameter. The output current may be derated to the ending current parameter when the actual temperature value is between the starting temperature and the ending temperature.

For example, the output current may be linearly reduced between temperature derating parameters, so that the output current is not derated if the actual temperature value is less than the starting temperature, and the output current is fully derated to the ending current when the actual temperature value is greater than the ending temperature.

In another exemplary aspect of the above-referenced embodiment, the temperature sensing circuit includes a voltage divider including a high side resistor and a low side resistor, wherein one of the high side resistor or the low side resistor is fixed, and a different one of the high side resistor or the low side resistor comprises a negative thermal coefficient (NTC) device.

In another exemplary aspect of the above-referenced embodiment, the NTC device generates the temperature sensor signal to be fed into the controller circuit.

In another exemplary aspect of the above-referenced embodiment, the temperature sensing circuit includes a capacitor for filtering the temperature sensor signal prior to being fed into the controller circuit.

In another exemplary aspect of the above-referenced embodiment, the driver housing further contains a configuration interface configured to receive and relate the temperature derating parameters from an external device to the controller circuit.

In another exemplary aspect of the above-referenced embodiment, the temperature derating parameters depend at least partially on at least one of a relationship between a temperature sensing circuit location of the temperature sensing circuit within the driver housing and a determined driver hotspot location within the driver housing or a relationship between the determined driver hotspot location and a determined fixture hotspot location of the light fixture.

A second exemplary embodiment of an invention as disclosed herein is for a lighting system comprising a light fixture including a fixture interior and a receptacle for receiving an LED load. A driver is positioned within the fixture interior and configured to supply an output current to the LED load. The driver includes a driver housing, itself further containing a temperature sensing circuit configured to generate a driver temperature signal corresponding to an internal driver housing temperature, and a controller coupled to the temperature sensing circuit. The controller is configured to receive the driver temperature signal, convert the driver temperature signal into an actual temperature, reduce the output current to a programmed output current level in response to the actual temperature being within a programmed temperature range. The programmed output current level and the programmed temperature range depends at least partially on the light fixture.

In one exemplary aspect of the above-referenced second embodiment, at least the programmed temperature range depends on a relationship between a fixture interior temperature of the light fixture and the internal driver housing temperature.

In another exemplary aspect of the above-referenced second embodiment, reducing the output current results in a reduction to both the fixture interior temperature and the internal driver housing temperature.

In another exemplary aspect of the above-referenced second embodiment, at least the programmed temperature range depends at least partially on at least one of a relationship between a temperature sensing circuit location of the temperature sensing circuit within the driver housing and a determined driver hotspot location within the driver housing or a relationship between the determined driver hotspot location and a determined fixture hotspot location of the fixture.

In another exemplary aspect of the above-referenced second embodiment, the programmed temperature range includes a starting temperature parameter and an ending temperature parameter, and the controller utilizes a transfer function to reduce the output current linearly when the actual temperature is between the starting and ending temperature parameters.

In another exemplary aspect of the above-referenced second embodiment, the temperature sensing circuit includes a voltage divider including a high side resistor and a low side resistor. One of the high side resistor or the low side resistor is fixed, and a different one of the high side resistor or the low side resistor comprises a negative thermal coefficient (NTC) device.

In another exemplary aspect of the above-referenced second embodiment, the driver housing further contains a configuration interface configured to receive and relate the programmed temperature range and programmed output current level from an external device to the microcontroller.

BRIEF DESCRIPTION OF THE SEVERAL VIEWS OF THE DRAWINGS

Several embodiments of the invention will be explained in detail with reference to at least the following drawings.

DETAILED DESCRIPTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

The following detailed description of embodiments of the present disclosure refers to one or more drawings. Each drawing is provided by way of explanation of the present disclosure and is not a limitation. Those skilled in the art will understand that various modifications and variations can be made to the teachings of the present disclosure without departing from the scope of the disclosure. For instance, features illustrated or described as part of one embodiment can be used with another embodiment to yield a still further embodiment.

The present disclosure is intended to cover such modifications and variations as come within the scope of the appended claims and their equivalents. Other objects, features, and aspects of the present disclosure are disclosed in the following detailed description. One of ordinary skill in the art will understand that the present discussion is a description of exemplary embodiments only and is not intended as limiting the broader aspects of the present disclosure.

Figure 1:
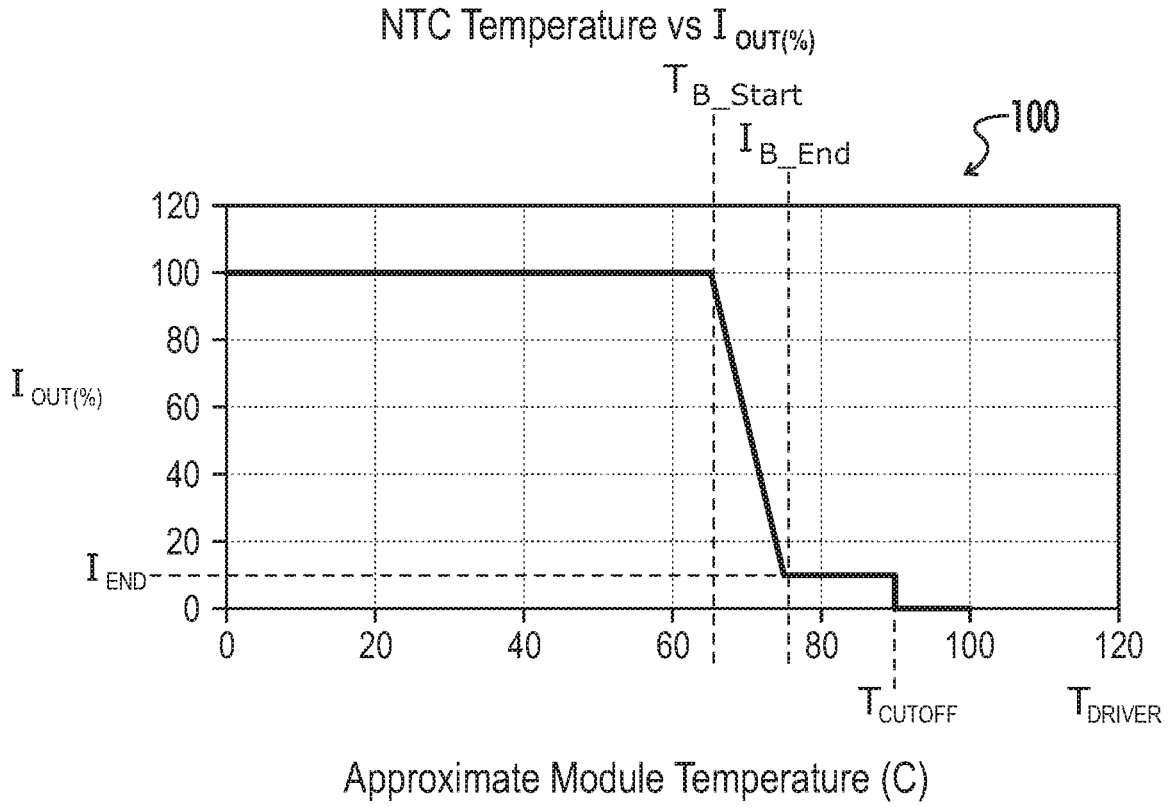
FIG. 1 illustrates a graph of a percentage of the output current which may be utilized by an LED load versus temperature.

Referring initially to FIG. 1, a foldback graph 100 is illustrated. The foldback graph 100 illustrates the output current $I_{OUT}$ as a percentage of a maximum output current of a driver module versus a driver module temperature $T_{DRIVER}$ of the driver module. The foldback graph 100 is created using a Murata NTC p/n NCP18XV103J03RB driver, but the type of driver module that may be used to generate such a foldback graph is not limited thereto. As illustrated in FIG. 1, the output current $I_{OUT}$ is substantially stable at 100% prior to a starting breakpoint temperature $T_{B_START}$. Above the starting breakpoint temperature $T_{B_START}$ the percentage of the output current $I_{OUT}$ available decreases (commonly known as current shedding). The current shedding is typically linear (i.e., has a constant slope) between the starting breakpoint temperature $T_{B_START}$ and an ending breakpoint temperature $T_{B_END}$. At the ending breakpoint temperature $T_{B_END}$ the output current $I_{OUT}$ stabilizes at an ending output current $I_{END}$ prior to the driver module temperature $T_{DRIVER}$ reaching a cutoff temperature $T_{CUTOFF}$, above which the driver module ceases to function. At the cutoff temperature $T_{CUTOFF}$ the output current $I_{OUT}$ is zero due to the fact that the driver module has ceased functioning.

Figure 2:
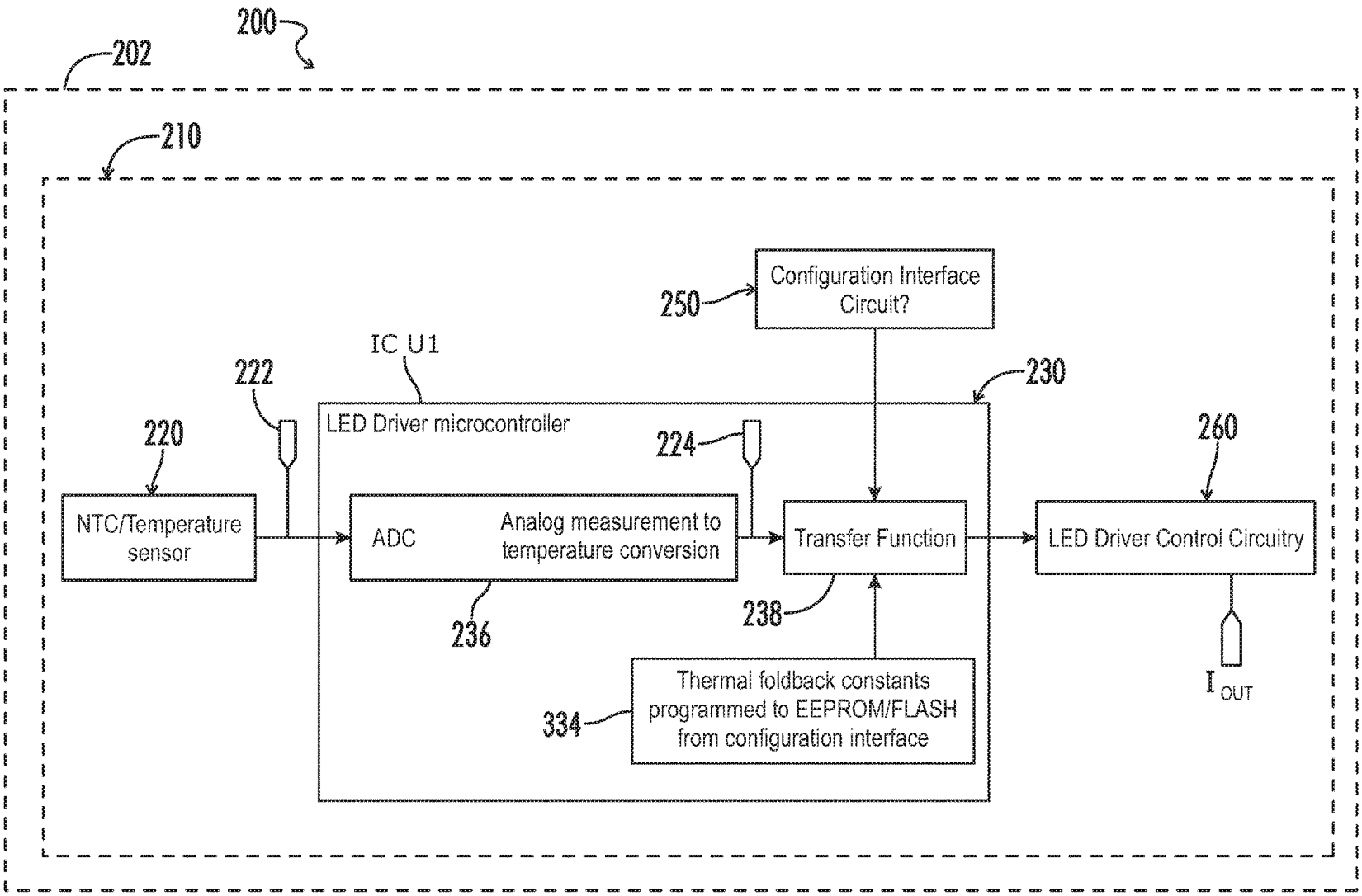
FIG. 2 illustrates a block diagram of the temperature sensor signal feeding into the LED driver's controller circuit and the controller circuit's processing of the temperature sensor signal to control the LED driver control circuitry in accordance with the present disclosure.

Referring next to FIG. 2, a block diagram of an exemplary light emitting diode (LED) driver 200 is shown. The LED driver 200 includes a driver housing 210 containing at least a temperature sensing circuit 220 and a controller circuit 230. The controller circuit 230 may also be referred to herein as a controller 230. The temperature sensing circuit 220 is configured to generating a temperature sensor signal 222 which corresponds to an actual temperature value 224 within the driver housing 210.

The controller circuit 230 is coupled to the temperature sensing circuit 220 within the driver housing 210. The controller circuit 230 includes memory 234 (e.g., EEPROM, Flash, or the like) that is configured to receive temperature derating parameters 240. The temperature derating parameters 240 are at least partially related to a fixture 202 configured to receive the driver housing 210. The controller circuit 230 is further configured receive the temperature sensor signal 222, convert the temperature sensor signal 222 into the actual temperature value 224 using an analog to digital converter (ADC) 236, and derate an output current $I_{OUT}$ of the LED driver 200 according to a transfer function 238 of the controller circuit 230 when the actual temperature value 224 falls within the temperature derating parameters 240. Accordingly, the transfer function 238 is at least partially dependent upon the received temperature derating parameters 240. The derating of the output current $I_{OUT}$ may be linear within the temperature derating parameters 240.

The LED driver 200 may further include a configuration interface circuit 250 and a power control stage 260 each coupled to the controller circuit 230 within the driver housing 210. The configuration interface circuit 250 is configured for programming the temperature derating parameters 240 as well as controlling other aspects of the LED driver 200 such as dimming capabilities. The controller circuit 230 that is configured to generate control signals to regulate one or more operations of a power stage (not shown), further in association with a power control stage 260 for the device.

The power stage may take any of numerous conventional forms for LED driver circuits such as for example based on a flyback converter arrangement. In one example consistent with the present disclosure the power stage includes input terminals to receive input power from an external power supply, such as for example an AC mains input, and is configured to convert the AC input power to provide an appropriate output power for driving a light source, or load. An exemplary LED load may comprise one or more LEDs connected in series between a first power stage output terminal and a second power stage output terminal, wherein a common load current flows through each LED in the LED load to cause the LEDs to illuminate. In alternative embodiments, the LED load may comprise a series-parallel combination of LEDs.

The exemplary power stage is configured to generate an output current $I_{OUT}$ to a light source comprising one or more LED's, based at least on a target output current set by the power control stage 260. The power stage may typically include an AC-DC section (not shown), configured for example as a diode bridge rectifier to convert the AC mains input into an intermediate DC bus voltage V1. A first output terminal of the bridge rectifier may be connected to a first terminal of the primary winding of an isolation transformer, which galvanically isolates a primary section of the power stage from a secondary section. The isolation transformer also has a secondary winding, and an N:1 turns ratio between the primary winding and the secondary winding, such that the voltage across the primary winding is N times the voltage across the secondary winding and such that the current through the secondary winding is N times the current through the primary winding. At least one switching element may be provided in the primary section, for example a switching element connected between the primary winding and a primary ground reference, wherein a switching frequency of the switching element(s) is regulated by gate drive signals from the controller circuit 230 or a separate gate drive controller to further regulate the current through the primary winding and to the secondary section of the power stage.

Figure 7:
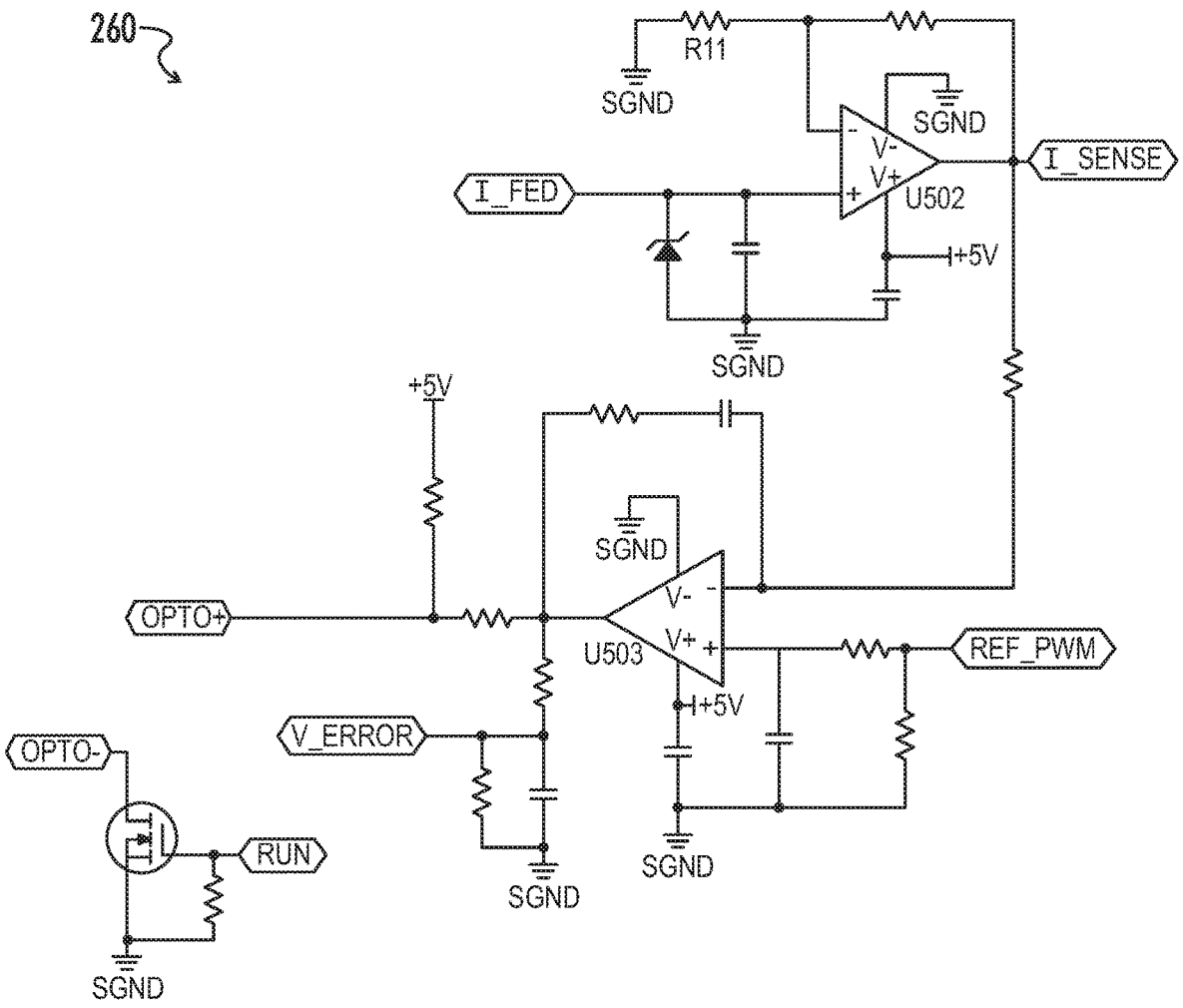
FIG. 7 illustrates a detailed schematic of a power control stage of the LED driver of FIG. 3

The exemplary power stage may further include a first terminal of the secondary winding of the isolation transformer connected to a secondary ground reference (see, e.g., SGND in FIG. 7). The secondary ground reference is electrically isolated from the primary ground reference by the isolation transformer. The secondary winding may further be connected to one or more secondary diodes and a secondary (output) filter capacitor. The secondary ground reference may be connected to an output terminal of the power stage via a current sensing resistor or the equivalent. Accordingly, when an output current LOUT flows through the LED load, a representative voltage develops across the current sensing resistor with respect to the secondary ground reference.

Figure 3:
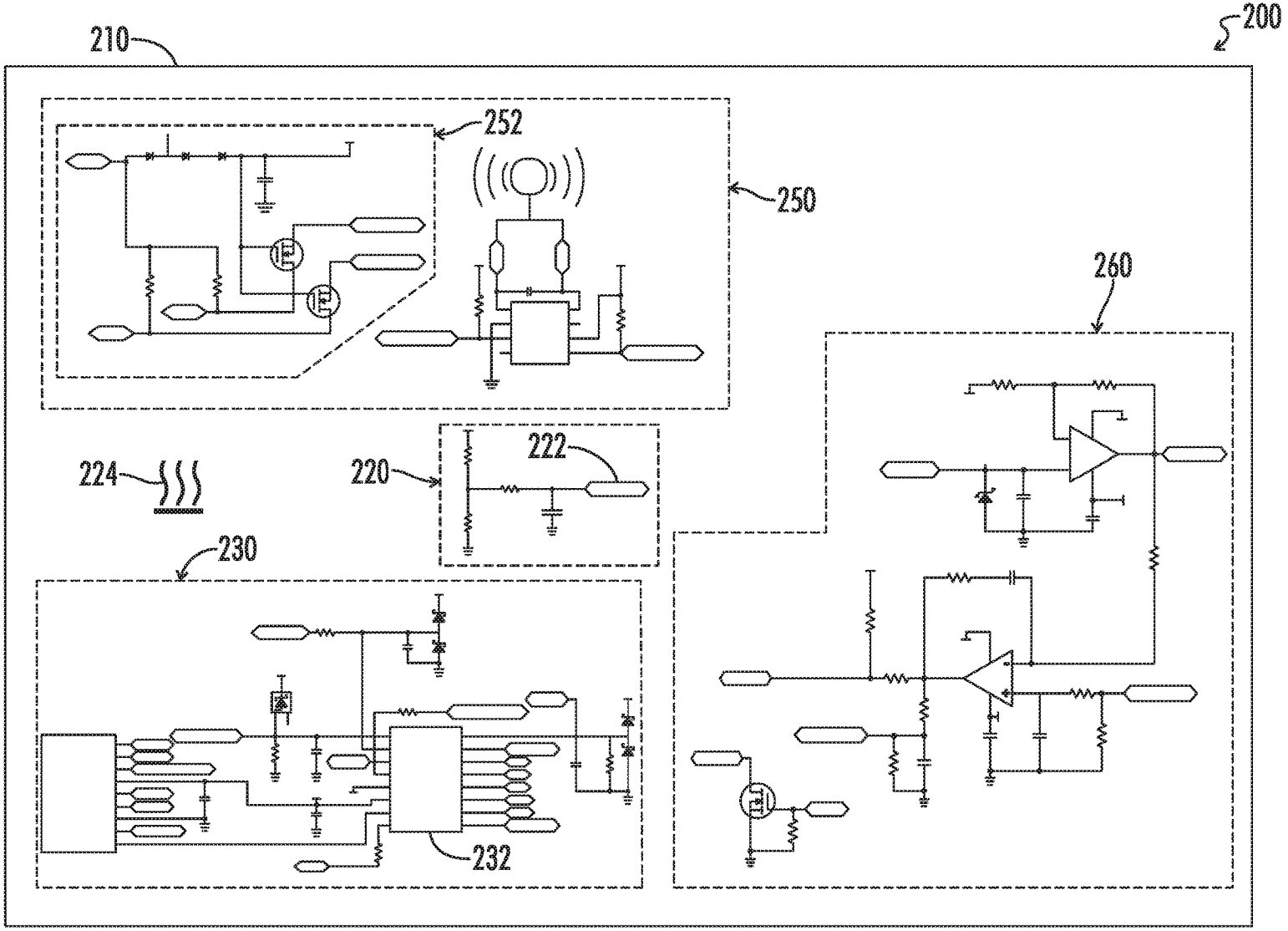
FIG. 3 illustrates a schematic of an LED driver including at least a controller circuit, a configuration interface circuit, and a temperature sensing circuit in accordance with the present disclosure.

Referring next to FIG. 3, an illustrative schematic of the LED driver 200 is provided. FIGS. 4-7 illustrate enlarged schematics for each of the temperature sensing circuit 220, the controller circuit 230, the configuration interface circuit 250, and the power control stage 260 of the LED driver circuit, respectively.

Figure 4:
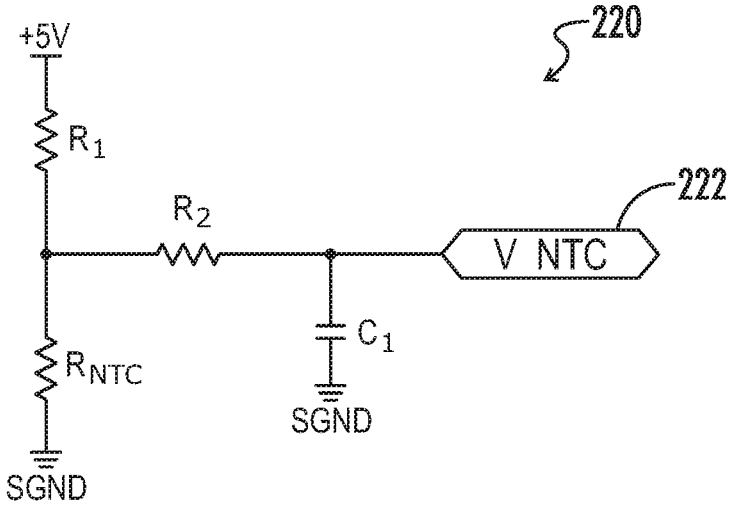
FIG. 4 illustrates a detailed schematic of the temperature sensing circuit of the LED driver of FIG. 3.

As shown in FIG. 4, an optional embodiment for the temperature sensing circuit 220 is illustrated includes a voltage divider formed by at least a high side resistor and a low side resistor. In certain optional embodiments, the high side resistor R1 is a fixed value and the low side resistor may be a negative thermal coefficient (NTC) sensor $R_{NTC}$. In other optional embodiments, the NTC sensor $R_{NTC}$ could be the high side resistor with a fixed low side resistor. The benefit of making the NTC sensor $R_{NTC}$ the low side resistor is that it allows for controllers with a low voltage internal ADC reference to take advantage of the low reference to improve the resolution (e.g., LSBs per mV or degree C.) of the NTC measurement and accordingly, the temperature sensing signal 222. For instance, the controller circuit 230 in FIGS. 3 and 5 has an internal Vdd/3 reference. The output voltage of the NTC circuit is about 1.4V at 0 degrees C. and only goes down from there at higher temperatures. Using the Vdd/3 (or 1.67V) reference allows for more LSBs of ADC resolution per mV than just using Vdd directly. The high side resistor is sized appropriately to bring the sensed signal into this range, as well as to limit the current through the NTC to minimize self-rise.

As previously mentioned, conventional arrangements have not incorporated the NTC (e.g., the temperature sensing circuit 222) into the LED driver itself, and would instead have physical lead wires exiting the LED driver's housing for the fixture manufacturer to connect to an NTC circuit located, e.g., somewhere else within the fixture. Conventional arrangements have also not been configurable (e.g., did not include the configuration interface circuit 250). Accordingly, the thermal foldback temperature range and output derating (e.g., the temperature derating parameters 240) were inherently fixed.

One advantage of incorporating the temperature sensing circuit 220 into the lighting fixture 202 itself is that the temperature sensor can be placed such that it is directly measuring the fixture's hotspot. However, for the invention disclosed herein, the relationship between the LED driver's internal NTC sensor $R_{NTC}$ and the LED driver's hotspot for a given input voltage VIN and output loading condition (e.g., current output $I_{OUT}$) can be determined. Likewise, the relationship between a hotspot of the LED driver 200 and a hotspot of the fixture 202 can be determined as well. The programmed temperature derating parameters 240 of the LED driver's configurable thermal foldback feature can be intelligently selected to correspond to fixture temperatures.

Figure 6:
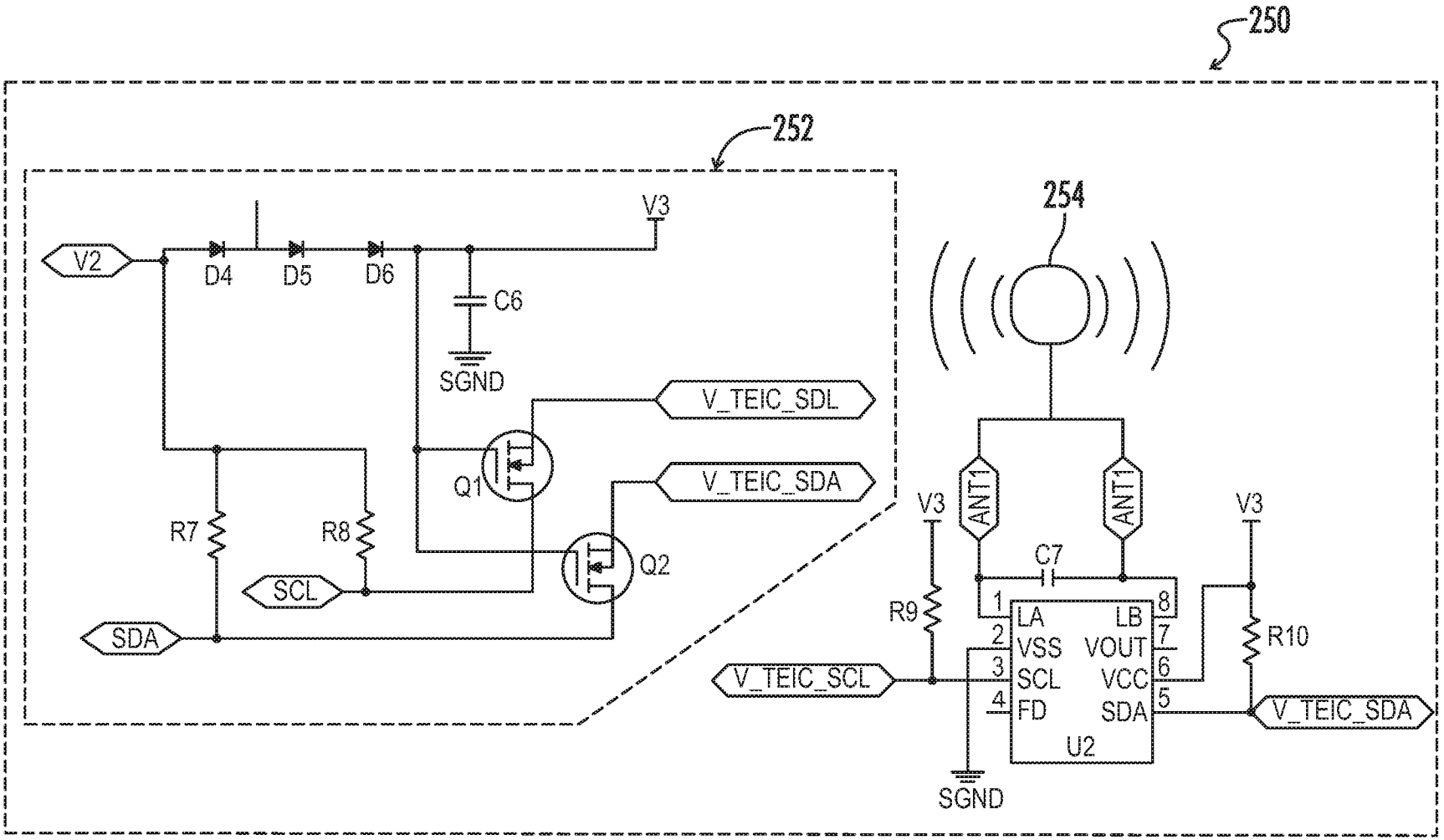
FIG. 6 illustrates a detailed schematic of the configuration interface circuit of the LED driver of FIG. 3.

Referring for illustrative purposes to FIG. 6, the control interface circuit 250 may be configured for wireless communication, for example with a device such as a configuration tool (not shown) external to the lighting fixture. Particular description or definition of an external NFC device is beyond the scope of this disclosure, but it may include an NFC antenna permanently mechanically coupled to the LED driver's NFC antenna, or temporarily but securely coupled to the LED driver's NFC antenna for unpowered LED driver parameter configuration or firmware update. The control interface circuit 250 is configured to receive the temperature derating parameters 240 and communicate said parameters to the controller circuit 230 to be implemented by the transfer function 238 when necessary.

The term "lighting device configuration data" may be used herein to refer to parameters that are received and stored for programming operation of the lighting device (e.g., LED driver). Exemplary configuration data may include parameters (or values associated with said parameters) such as minimum and maximum output currents, dimming curve (e.g., linear, logarithmic), dimming control voltages, on/off states for enabling or disabling various programmable features such as lumen maintenance, a threshold voltage for triggering on/off functions, etc.

The term "dimming control data" may typically as used herein refer to digital inputs corresponding to a lighting output such as a 0-100% dimming value, or an equivalent as allowable for the particular lighting device or load. Otherwise stated, the dimming control data may specify a desired lighting output, whereas the device configuration data may specify internal operating parameters enabling the device controller to appropriately provide the desired lighting output.

The controller circuit 230 may be configured to provide gate driving signals directly to one or more switching elements in the LED driver power stage, or may alternatively be configured to for example provide dimming control signals to a gate driver circuit that provides the aforementioned driving signals to the one or more switching elements, based in part on power stage feedback signals such as for example actual output current. Still further in the alternative, the illustrated controller circuit 230 may be separately provided with respect to another power stage controller or associated circuitry (not shown) which itself receives dimming reference signals from the controller circuit 230 and generates gate driver control signals to the switching elements based on power stage feedback. In such embodiments, the power control stage 260 may for example include a proportional integral (PI) control loop with an operational amplifier or equivalent for comparing a dimming output signal from the controller circuit 230 with feedback signals for the purpose of generating an error signal, further fed back directly or via an isolation element to a gate drive integrated circuit for regulating switching operation (e.g., duty cycle control) of the switching elements in the power stage.

An exemplary embodiment of the power control stage 260 circuitry is shown in FIG. 7, including analog electronics which create the control loop for the power stage (not shown). In the illustrated example, an input signal (I_FED) representative of the current through the load is provided to an input terminal (U502+) of a current sensing amplifier, which in this case comprises a first conventional operational amplifier, which is configured as a single-ended amplifier to buffer and amplify the relatively small current with respect to a secondary ground reference (SGND) in the power stage, and further to provide an output signal (I_SENSE) on an output terminal. In alternative embodiments (not shown), the current voltage amplifier may be configured as a voltage sensing amplifier to receive a sensed voltage across a sensing resistor in series with the load, or may be configured as a differential amplifier without reference to the secondary ground reference.

The output terminal of the current sensing amplifier U502 is connected to a first input terminal (U503−) of a current difference circuit, which has a second input terminal (U503+) and an output terminal. The second input terminal of the current difference circuit is connected to receive a reference input (REF_PWM). In the illustrated embodiment, the difference circuit may comprise a second conventional operational amplifier, which is configured to output a voltage signal (OPTO+) on the output terminal that is responsive to a difference between the voltages on the first and second input terminals. The reference input is proportional to a desired current through the LED load.

For example, in one embodiment of the driver circuit, the desired current through the LED load is 180 milliamps. The reference voltage corresponding to the desired current is selected such that when 180 milliamps is sensed through a current sensing resistor in the power stage, the sensed current (I_SENSE) as amplified by the first operational amplifier U502 is substantially equal to the reference voltage. The difference circuit outputs a first (nominal) voltage when the two inputs are substantially equal. If the amplified sensing value differs from the reference value, the difference circuit outputs a voltage having an amplitude that differs from the first voltage by a magnitude and a direction (e.g., more than or less than the first voltage) responsive to the difference between the two input values. For example, in one embodiment, the first (nominal) voltage may be set to approximately one-half of the rail-to-rail supply voltage of the second operational amplifier such that the output of the second operational amplifier is a voltage that varies with respect to the nominal voltage.

As further described below, the second input (REF_PWM) may be a pulse width modulated (PWM) reference signal provided by the controller circuit 230, wherein the first and second inputs (I_FED, REF_PWM) define a target output current. An output from the second operational amplifier U503 is provided to define an output signal (OPTO+) for current control of the power stage, and further defining a feedback error value (V_ERROR) to the controller circuit 230 IC (U1).

The terms "controller," "controller circuit" and "controller circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Figure 5:
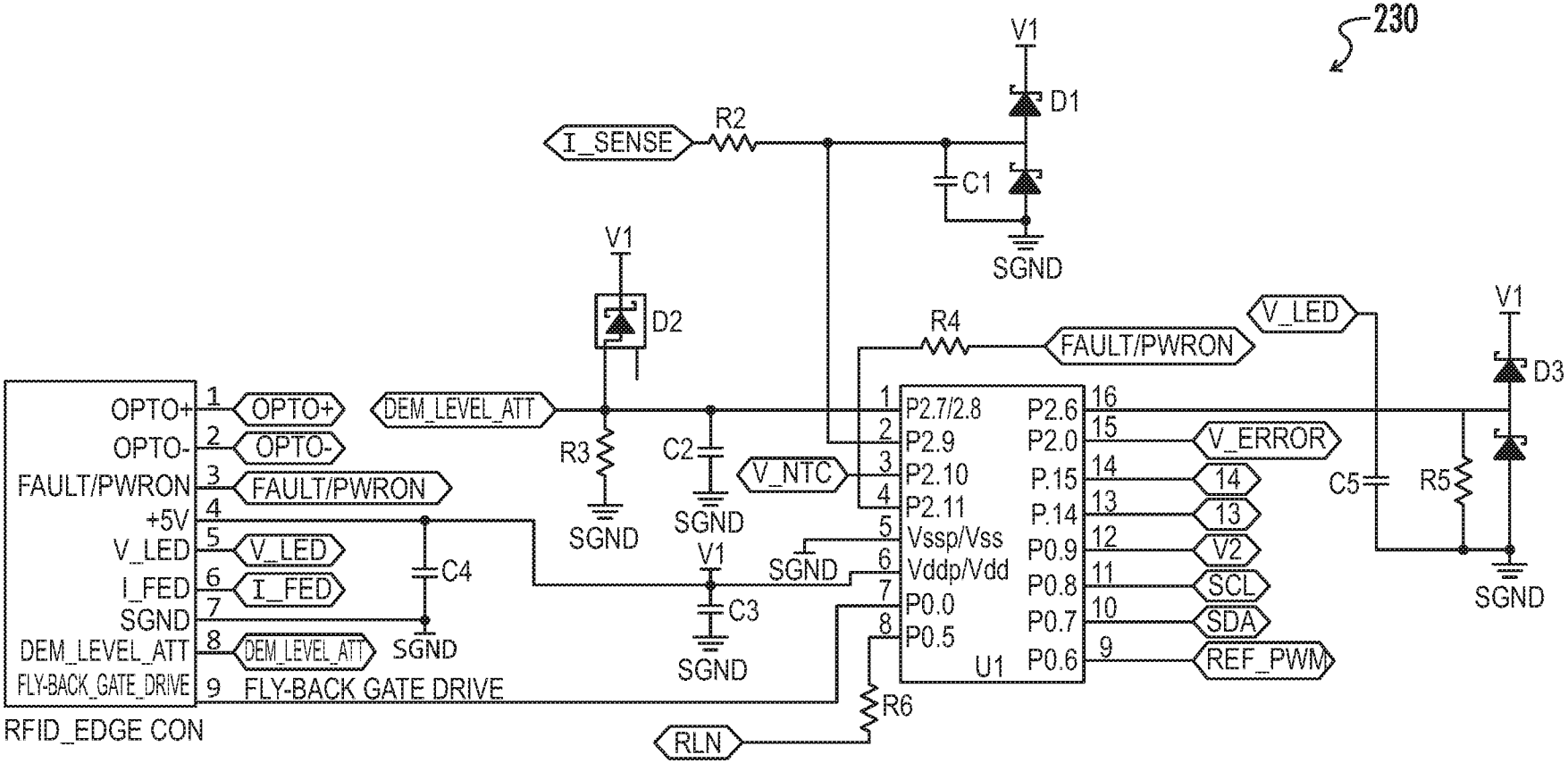
FIG. 5 illustrates a detailed schematic of the controller circuit of the LED driver of FIG. 3.

Referring for illustrative purposes to the circuit diagram of FIG. 5, the controller circuit 230 may include an integrated circuit (IC) U1 and associated discrete circuitry. The IC receives feedback signals such as for example an output current sensing input (I_sense) from a current sensor coupled in series with the load, a voltage sensing input (V_LED), etc. The controller circuit 230 senses or determines a dimming control voltage and provides a pulse width modulated (PWM) reference output signal (REF_PWM), for example according to a dimming curve set by an internal algorithm. The controller circuit 230 is interfaced to an I2C interface (SDA, SCL pins) of an NFC tag IC (U2 in FIG. 6) via pins P0.7 and P0.8 of IC U1. The controller circuit 230 also provides power to the configuration interface circuit 250 through general purpose IO pin P0.9.

In this example, the controller circuit 230 runs off of a first voltage V1 (e.g., 5V) as derived from the LED driver power stage, and the controller interface circuit 250 runs off of a second voltage V3 (e.g., 3.6V maximum). Accordingly, an output voltage V2 from the controller circuit 230 may be reduced through three series diodes D4, D5, D6 in level shifting circuit 252 (see FIG. 6) to a safe supply voltage V3 for the wireless interface circuit tag IC (U2), and the I2C interface is level-shifted to provide safe and recognizable digital levels on both sides of the interface. The serial data pin SDA from the controller IC is provided to the level shifting circuit 252 and coupled to the drain of switching element Q2, while the source of switching element Q2 is coupled to the serial data pin (pin 5 of U2) in the controller interface circuit 250. A resistor R7 is coupled between the controller's output voltage V2 and the serial data input SDA, and the level-shifted supply voltage V3 is coupled to the gate of the switching element Q2. The serial clock pin SCL from the controller IC is also provided to the level shifting circuit 252 and coupled to the drain of a switching element Q1, while the source of switching element Q1 is coupled to the serial clock pin (pin 3 of U2) in the controller interface circuit 250. Another resistor R8 is coupled between the controller's output voltage V2 and the serial clock input SCL, and the level-shifted supply voltage V3 is coupled to the gate of the switching element Q1.

The tag IC itself is connected to an NFC antenna 254, which in an embodiment may simply be formed by a plurality of turns on a multi-layer printed circuit board (PCB) that is outside of—or simply not fully encased within—the LED driver's housing (e.g., a metal can).

The aforementioned configuration and associated circuit components may allow a configuration tool (e.g., NFC device) external to the LED driver to establish communication with the LED driver's controller when the LED driver is powered by an AC mains input, via the inherently isolated NFC interface. Because the NFC interface itself is electrically isolated, there is no further need for isolation internal to the LED driver for the communication interface. In certain optional embodiments, it may be understood that an external NFC-enabled device could itself be powered directly by the same AC mains as the lighting device. Alternatively, the external NFC-enabled device and the controller circuit 230 of the LED driver may use the Tag IC's volatile SRAM as the communication medium.

Figure 8:
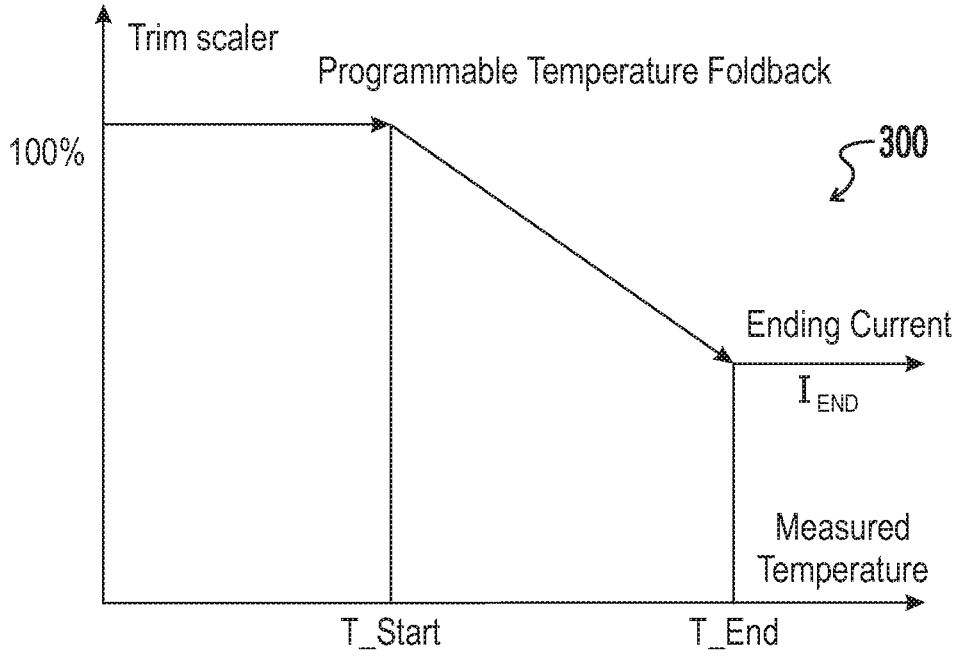
FIG. 8 illustrates a transfer function graph corresponding to the behavior of a transfer function of the controller circuit of the LED driver of FIG. 3

One example of novelty associated with the aforementioned approach is the incorporation of the temperature sensing circuit 220 within the driver housing 210 and that the temperature derating parameters 240 can be configured and customized to a given fixture using the configuration interface circuit 250. The temperature derating parameters 240 can be written to the IC U1 via the configuration interface circuit 250. As can best be seen in FIG. 8, a transfer function graph 300 corresponding to the behavior of the transfer function 238 with configurable starting and ending temperature parameters as well as an ending current parameter is illustrated. As previously mentioned, the transfer function 238 is at least partially dependent upon the received temperature derating parameters 240. The temperature derating parameters 240 include a start temperature $T_{START}$, an ending temperature TEND, and an ending output current $I_{END}$ which used for the programmable temperature foldback feature and which are clearly shown in the transfer function graph 300.

Figure 10:
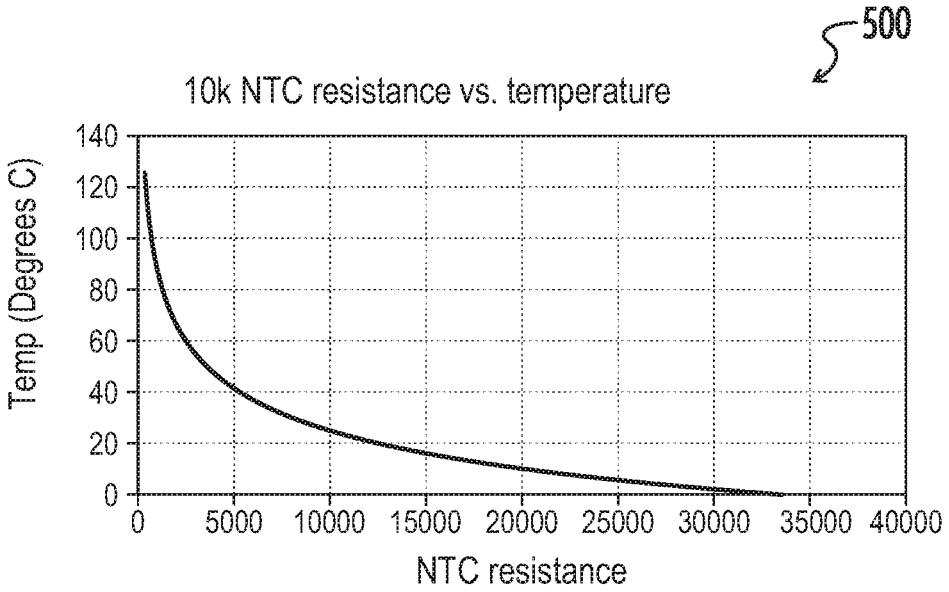
FIG. 10 illustrates a graph of the resistance of an NTC sensor of the temperature sensing circuit of FIG. 3 versus temperature.
Figure 11:
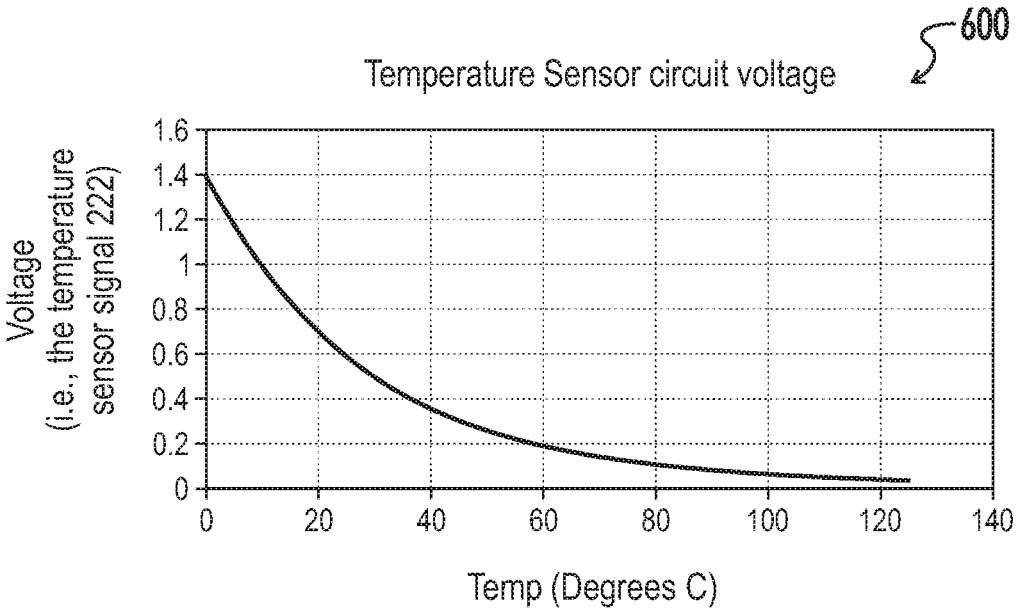
FIG. 11 illustrates a graph of the voltage of a temperature sensor signal of the temperature sensing circuit of FIG. 3 versus temperature.

As can best be seen in FIGS. 10 and 11, when an NTC sensor $R_{NTC}$ is used in the temperature sensing circuit 220, its resistance is very non-linear versus temperature (shown by graph 500 in FIG. 10) and consequently its voltage (i.e., the temperature sensor signal 222) versus temperature is also non-linear (shown by graph 600 in FIG. 11). Because it is desirable for the reduction of output current $I_{OUT}$ of the LED driver 200 to be made linear with temperature over an arbitrary temperature range of temperature values, the IC U1 must be capable of implementing NTC measurement temperature conversion. The resistance of the NTC sensor $R_{NTC}$ at a given temperature is given by the following equation:

$$R = R_o e^{\beta\left(\frac{1}{T}-\frac{1}{T_o}\right)} \tag{1}$$

$R_o$ equals the resistance at a reference temperature, typically 298.15K (25 Degrees C.)

T equals temperature in K $T_o$ equals 298.15K

β equals the thermistor constant

Rearranging equation (1) to solve for T gives:

$$T = \frac{\beta}{\ln\left(\frac{R}{R_o}\right) + \frac{\beta}{T_o}} \tag{2}$$

Rewriting equation (2) in terms of sensed voltage gives:

$$T = \frac{\beta}{\ln\left(\frac{\left(\frac{V_o R_{hi}}{V_i - V_o}\right)}{R_o}\right) + \frac{\beta}{T_o}} \quad (3)$$

$V_o$ equals the sensed voltage $V_i$ equals the input voltage to the NTC circuit $R_{hi}$ equals the high side resistor resistance value The IC U1 of the controller circuit 230 can implement equation (3) directly, or it can synthesize the temperature with a set of polynomial curve fitting equations. Converting the sensed value (i.e., the temperature sensing signal 222) to the actual temperature value 224 linearizes the measurement.

From there, the reference from the output current can then be set with the following equation (over the temperature range $T=T_{START}$ to $T=T_{END}$):

$$I_{out} = I_{max} * \left\{\text{Setpoint} * \left[\text{Trim} * \left(1 - \frac{(1-A)(T - T_{start})}{T_{end} - T_{start}}\right) - \text{Floor}\right] + \text{Floor}\right\} \quad (4)$$

Setpoint equals the output current $I_{OUT}$ demand level set by the dimming interface (i.e., the level shifting circuit 252)

Floor equals the minimum output current percentage of the driver

Trim equals the configured output current percentage (i.e., the ending output current $I_{END}$)

Figure 9:
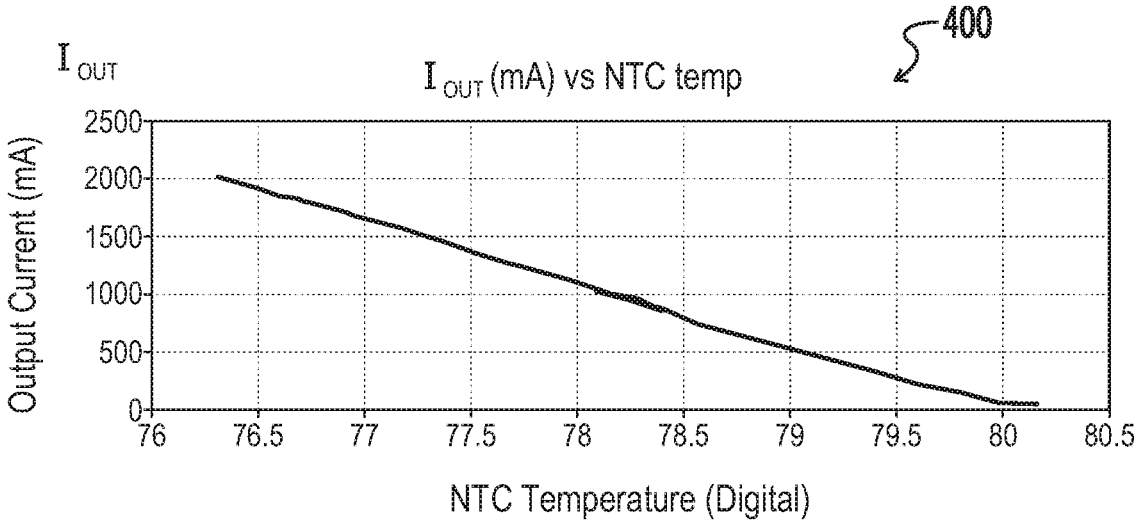
FIG. 9 illustrates a graph of the output current of the LED driver of FIG. 3 versus temperature.

$T_{START}$ equals the configured starting temperature $T_{END}$ equals the configured ending temperature A equals the configured ending thermal foldback current percentage If Trim, Floor, Setpoint, A, $T_{START}$, and $T_{END}$ are fixed, then it can be seen from equation (4) that the reduction in output current $I_{OUT}$ becomes linear with respect to temperature for arbitrarily selected temperature ranges (shown by graph 400 in FIG. 9). This would not be the case if the measured analog value (i.e., the temperature sensing signal 222) were directly used. As you can see from FIG. 10, the analog measurement is nonlinear. If the analog measurements were directly used instead of the actual temperature value 224 and the starting and ending temperature configurable parameters were instead starting and ending voltages or resistances, then the output current $I_{OUT}$ response would no longer be linear with respect to temperature for an arbitrary range of selected temperature values. In such an embodiment, a discrete IC could instead be used that outputs an analog signal that is linear with respect to temperature (Microchip MCP9701 for example), or a discrete IC that utilizes I2C or some other interface to convey a digitized temperature value, but such IC's tend to be much more expensive than the NTC sensor $R_{NTC}$, the resistors R1, R2, and the capacitor C1 that make up the temperature sensing circuit 220.

Figure 12:
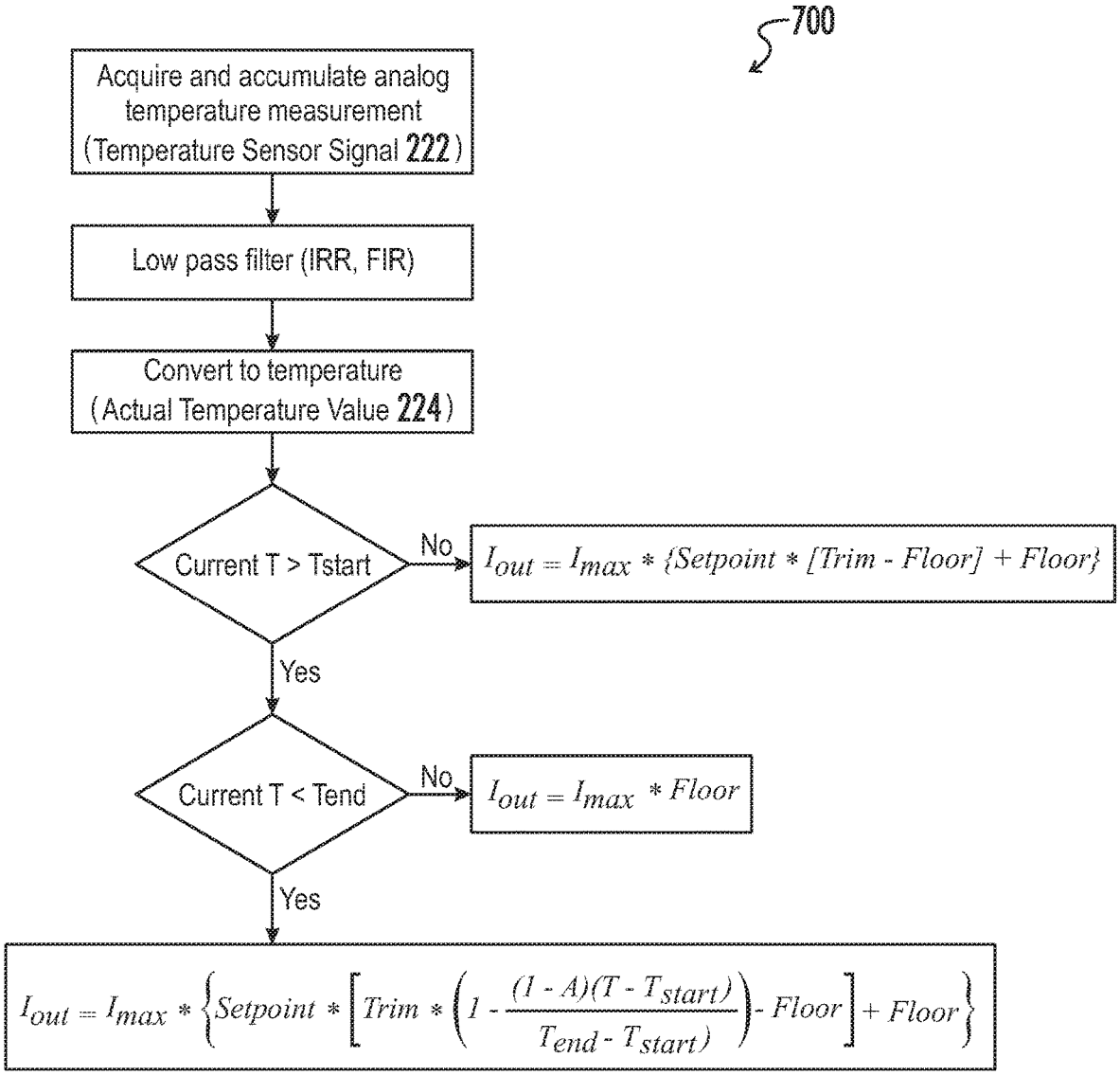
FIG. 12 illustrates a block diagram of the temperature-related logic of the controller circuit of FIG. 3.

As can best be seen in FIG. 12, a block diagram 700 of the temperature related logic running in the IC U1 of the controller circuit 230 is shown. The temperature sensor signal 222 is acquired, filtered, and converted to the actual temperature value 224. The output current $I_{OUT}$ is then derated based on where the measure temperature is in relation to the programmed temperature values (e.g., the starting temperature $T_{START}$ and the ending temperature $T_{END}$ of the temperature derating parameters 240). The filtering stage (e.g., resistor R2 and capacitor C1 of the temperature sensing circuit 220) serves to eliminate noise on the sensed temperature signal and to control the slew rate of the output current $I_{OUT}$ reduction due to an elevated temperature. In effect, this serves to prevent flickering and noticeable strobing or oscillation of the light output from the fixture 202.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An LED driver configured to supply an output current to an LED load, the LED driver comprising:

a driver housing having disposed therein:

a temperature sensing circuit configured to generate a temperature sensor signal corresponding to an actual temperature value within the driver housing; and a controller circuit coupled to the temperature sensing circuit, the controller circuit configured to:

receive programmable temperature derating parameters at least partially related to a light fixture configured to receive the driver housing;

convert the temperature sensor signal into the actual temperature value; and derate the output current in accordance with a transfer function of the controller circuit when the actual temperature value falls within the temperature derating parameters, wherein the temperature derating parameters depend at least partially on at least one of a relationship between a temperature sensing circuit location of the temperature sensing circuit within the driver housing and a determined driver hotspot location within the driver housing or a relationship between the determined driver hotspot location and a determined fixture hotspot location of the light fixture.

2. The LED driver of claim 1, wherein:

the temperature derating parameters include a starting temperature, an ending temperature, and an ending current parameter; and the output current is derated to the ending current parameter when the actual temperature value is between the starting temperature and the ending temperature.

3. The LED driver of claim 2, wherein:

the temperature sensing circuit includes a voltage divider including a high side resistor and a low side resistor;

one of the high side resistor or the low side resistor is fixed; and a different one of the high side resistor or the low side resistor comprises a negative thermal coefficient (NTC) device.

4. The LED driver of claim 3, wherein:

the NTC device generates the temperature sensor signal to be fed into the controller circuit.

5. The LED driver of claim 3, wherein:

the temperature sensing circuit includes a capacitor for filtering the temperature sensor signal prior to being fed into the controller circuit.

6. The LED driver of claim 1, wherein the driver housing further contains:

a configuration interface configured to receive and relate the temperature derating parameters from an external device to the controller circuit.

7. A lighting system comprising:

a light fixture including a fixture interior and a receptacle for receiving an LED load; and a driver positioned within the fixture interior and configured to supply an output current to the LED load, the driver including a driver housing containing:

a temperature sensing circuit configured to generate a driver temperature signal corresponding to an internal driver housing temperature; and a controller coupled to the temperature sensing circuit, the controller configured to receive the driver temperature signal, convert the driver temperature signal into an actual temperature, reduce the output current to a programmed output current level in response to the actual temperature being within a programmed temperature range, wherein:

the programmed output current level and the programmed temperature range depends at least partially on the light fixture, and at least the programmed temperature range depends on a relationship between a fixture interior temperature of the light fixture and the internal driver housing temperature.

8. The lighting system of claim 7, wherein:

reducing the output current results in a reduction to both the fixture interior temperature and the internal driver housing temperature.

9. The lighting system of claim 7, wherein:

at least the programmed temperature range depends at least partially on at least one of a relationship between a temperature sensing circuit location of the temperature sensing circuit within the driver housing and a determined driver hotspot location within the driver housing or a relationship between the determined driver hotspot location and a determined fixture hotspot location of the fixture.

10. The lighting system of claim 7, wherein:

the programmed temperature range includes a starting temperature parameter and an ending temperature parameter; and the controller utilizes a transfer function to reduce the output current linearly when the actual temperature is between the starting and ending temperature parameters.

11. The lighting system of claim 7, wherein:

the temperature sensing circuit includes a voltage divider including a high side resistor and a low side resistor;

one of the high side resistor or the low side resistor is fixed; and a different one of the high side resistor or the low side resistor comprises a negative thermal coefficient (NTC) device.

12. The lighting system of claim 7, wherein the driver housing further contains:

a configuration interface configured to receive and relate the programmed temperature range and programmed output current level from an external device to the microcontroller.

13. A method of providing power to a load comprising at least one particular light-emitting diode (LED) comprising:

providing a lighting fixture with a power driver positioned therein, the power driver comprising a temperature sensing circuit positioned therein and a controller circuit coupled thereto;

coupling the particular LED to both the lighting fixture and a driver output of the power driver;

programming the controller circuit with temperature derating parameters comprising a starting temperature, an ending temperature, and an ending current associated with a thermal foldback feature of the power driver;

sensing a driver temperature of the power driver, the driver temperature associated with an operating temperature of the particular LED; and linearly reducing an output current of the power driver to the ending current when the sensed driver temperature falls between the starting temperature and the ending temperature, wherein derating of the output current is disabled when the sensed driver temperature is less than the starting temperature, wherein the output current is fully reduced to the ending current when the sensed driver temperature is greater than the ending temperature.

14. The method of claim 13, wherein:

the temperature sensing circuit includes a voltage divider including a high side resistor and a low side resistor;

one of the high side resistor or the low side resistor is fixed; and a different one of the high side resistor or the low side resistor comprises a negative thermal coefficient (NTC)

device which generates the temperature sensor signal to be fed into the controller circuit.

15. The method of claim 14, further comprising filtering the temperature sensor signal prior to being fed into the controller circuit.

16. The method of claim 13, further comprising receiving and relating the temperature derating parameters from an external device to the controller circuit.

17. The method of claim 13, wherein:

the temperature derating parameters depend at least partially on at least one of a relationship between a temperature sensing circuit location of the temperature sensing circuit within a driver housing and a determined driver hotspot location within the driver housing or a relationship between the determined driver hotspot location and a determined fixture hotspot location of the lighting fixture.

* * * * *